United States Patent [19]

Hsu

[11] Patent Number: 4,648,846

[45] Date of Patent: Mar. 10, 1987

[54] PEDAL BOAT

[76] Inventor: Chen-Hsiung Hsu, 2 Fl., No. 20-3, Peiping E. Rd., Taipei, Taiwan

[21] Appl. No.: 738,751

[22] Filed: May 29, 1985

[51] Int. Cl.[4] ..... B63B 35/72

[52] U.S. Cl. ..... 440/31; 440/60

[58] Field of Search ..... 440/21, 26, 27, 31, 440/49, 51, 53, 58, 60, 76, 78, 83; 441/40; 114/345

[56] References Cited

U.S. PATENT DOCUMENTS

| | | | |
|---|---|---|---|
| 2,684,045 | 7/1954 | Cato | 440/31 |
| 2,843,859 | 7/1958 | Gongwer | 440/31 |
| 3,131,406 | 5/1964 | Cousteau | 441/40 |
| 3,339,218 | 9/1967 | Stamberger | 440/40 |
| 3,425,071 | 2/1969 | Frieder | 440/40 |
| 3,781,933 | 1/1974 | Soter . | |
| 4,459,116 | 7/1984 | Moore | 440/31 |

*Primary Examiner*—Trygve M. Blix
*Assistant Examiner*—C. T. Bartz
*Attorney, Agent, or Firm*—Bacon & Thomas

[57] ABSTRACT

The present invention relates to a pedal boat and in particular to one having two inflation members connected by a transverse rod, a seat mounted on the middle of the transverse rod, a transmission gear, a pair of pedals operatively associated with the transmission gear and a propeller connected to the lower end of the transmission gear, whereby the boat can be easily propelled in the water by use of the pedals.

1 Claim, 4 Drawing Figures

PEDAL BOAT

BACKGROUND OF THE INVENTION

This invention relates to a pedal boat which is convenient for obtaining propulsion in the water. The structure of the pedal boat in this invention differs from the conventional foot-pedaled boat, because the propeller in the foot-pedaled boat is rotated by chains and chain gears, while the propeller of the boat according to this invention is rotated by transmission gear. Generally, the power equipment of a foot-pedaled boat is established by the pedal, chain gears and chains. It is apparent that the conventional foot-pedaled boat is complicated in structure and difficult to control.

Accordingly, it is an object of the present invention to provide a pedal boat which may obviate and mitigate the above-mentioned drawbacks.

SUMMARY

It is the primary object of the present invention to provide a pedal boat which is simple in construction.

It is another object of the present invention to provide a pedal boat which is inexpensive to manufacture.

It is still another object of the present invention to provide a pedal boat which is easy to operate.

It is still another object of the present invention to provide a pedal boat which is collapsible.

It is a further object of the present invention to provide a pedal boat which may be conveniently carried from one location to another.

Other objects and merits and a fuller understanding of the present invention will be obtained by those having ordinary skill in the art when the following detailed description of the best mode contemplated for practicing the invention is read in conjunction with the accompanying drawings wherein like numerals refer to like or similar parts in which:

DETAILED DESCRIPTION OF THE PREFERRED EMBODIMENT

Before explaining the present invention in detail it is to be understood that the invention is not limited in its application to the details of construction and arrangement of parts illustrated in the accompanying drawings, since the invention is capable of other embodiments and of being carried out in various ways. Also, it is to be understood that the phraseology or terminology employed herein is for the purpose of description and not of limitation.

Figure 1:
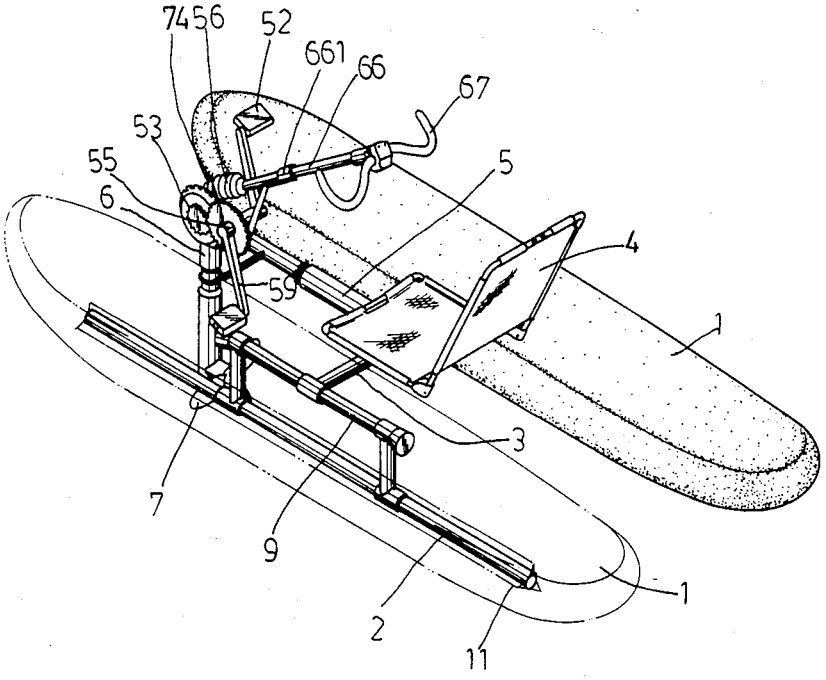
FIG. 1 is a perspective view of a pedal boat according to a preferred embodiment of the present invention.
Figure 2:
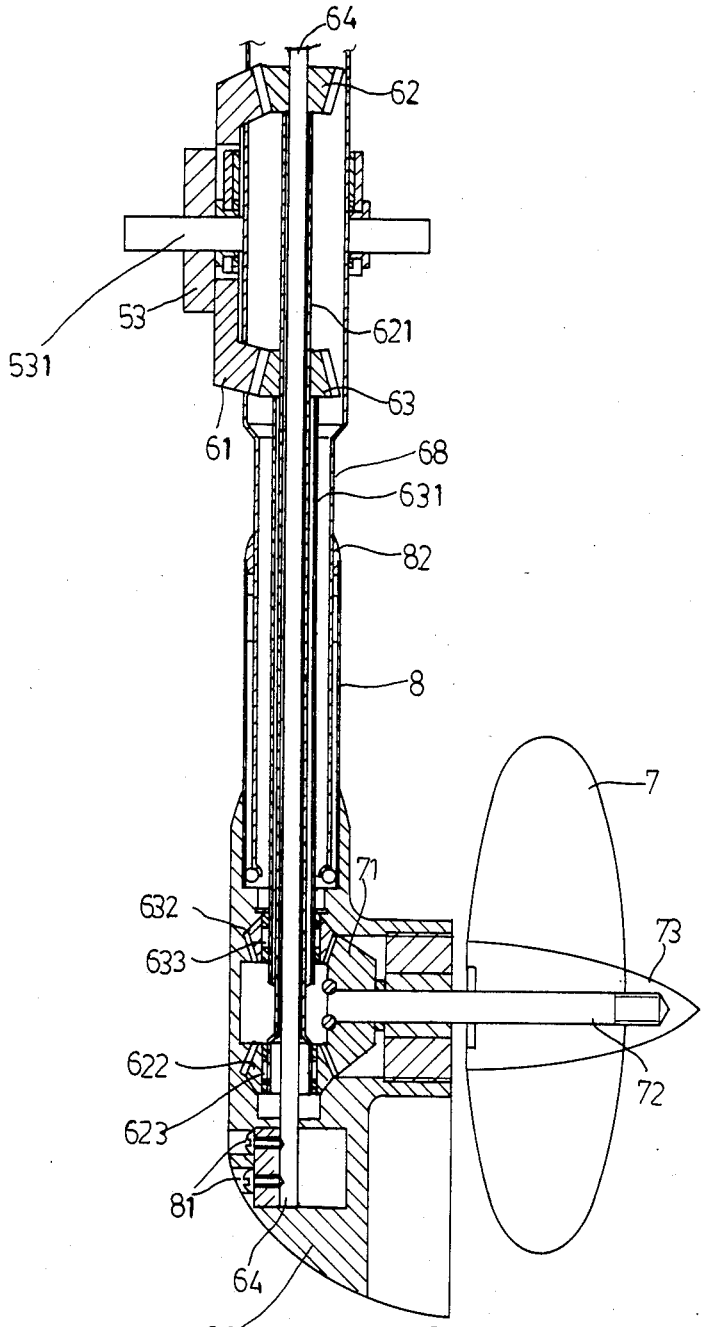
FIG. 2 is a sectional view of the transmission gear of the pedal boat.
Figure 3:
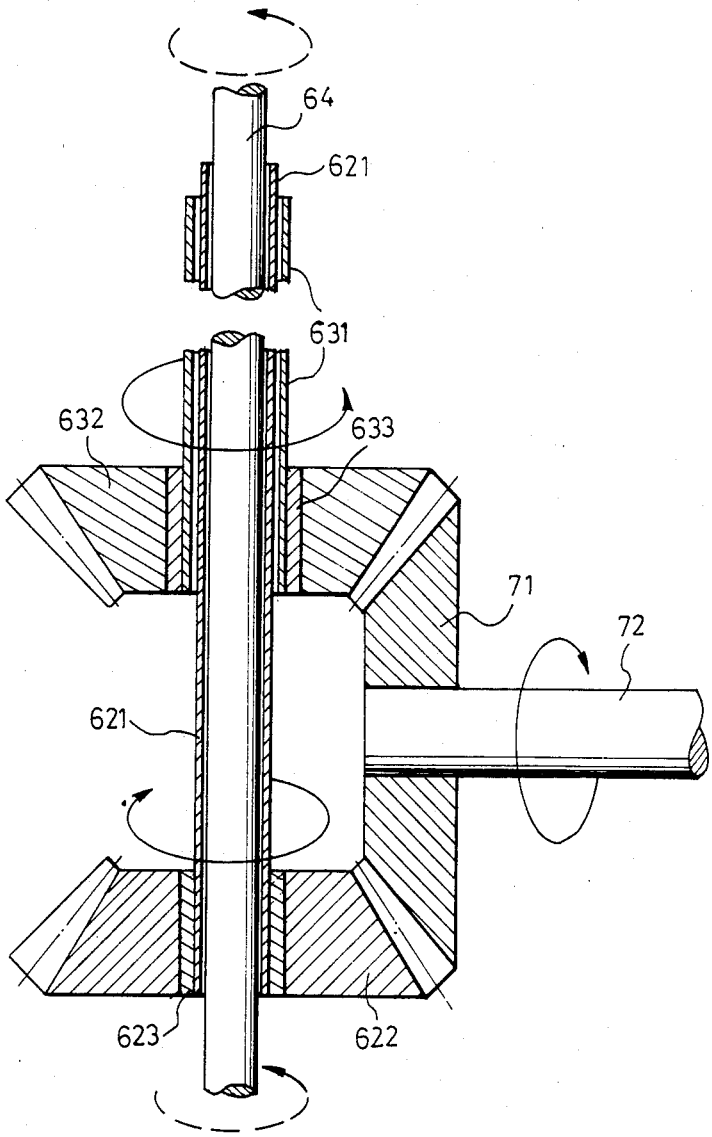
FIG. 3 is an enlarged fragmentary view of the transmission gear.

Referring to the drawings and in particular to FIG. 1 thereof, the pedal boat according to the present invention comprises two inflation members 1, two telescopic rods 2 (only one of them is shown), a seat 4, a pair of pedals 52, a transmission gear 6 and a propeller 7. The inflation member 1 is made of rubber, within which is a sleeve 11 integral therewith. The telescopic rod 2 is put into the sleeve 11 so that it can be fixed in position. A supporting frame 9 is disposed on the telescopic rod 2 and within the inflation member 1. Between the two supporting frame 9 there is a transverse rod 3 on which is mounted the seat 4. From the middle of the transverse rod 3 extends a contractible rod 5 which is secured at one end to the transmission gear 6. On the contractible rod 5 there is a supporting member 57 (not shown) through which is a shaft 55. The shaft 55 is provided at each side with a crank 59 on which is pivoted the pedal 52. A driving wheel 74 is keyed or otherwise secured to the shaft 55 so that the driving wheel 74 can be rotated therewith.

The transmission gear 6 comprises a tubular casing 68 which is connected at the lower end with a housing 90. The tubular casing 68 is enclosed by a cylindrical member 8 at the lower part. On the upper part of the tubular casing 68 is pivoted a stud 531 to which is keyed or otherwise secured a bevel gear 61. A driven gear 53 is mounted on the outer side of the bevel gear 61 and also keyed or otherwise secured to the stud 531 so that the driven gear 53 can be rotated in unison with the bevel gear 61. The bevel gear 61 is engaged at the upper part with a first side gear 62 and a second side gear 63. The first side gear 62 is rotatably mounted on a vertically disposed steering axle 64. The steering axle 64 extends downwardly into the housing 90 and secured thereto by screws 81. Hence, the housing 90 can be rotated with the steering axle 64. A first hollow axle 621 enclosing the steering axle 64 is fastened to the bottom surface of the first side gear 62. The first hollow axle 621 extends downwardly to connect with a first pinion 622 via a single-way bearing 623. A second hollow axle 631 enclosing the first hollow axle 621 is fastened to the bottom surface of the second side gear 63. The second hollow axle 631 extends downwardly to connect with a second pinion 632 via a single-way bearing 633. The directions of the two single-way bearings 633 and 623 are opposite. The pinions 632 and 622 respectively mesh with the upper part and the lower part of a bevel gear 71. The bevel gear 71 is fixedly mounted on a shaft 72 which is provided with a propeller 7 at the other end.

The upper end of the steering axle 64 is connected with a universal joint 56 which is in turn connected with a shaft 66. The shaft 66 is supported on the contractible rod 5 by means of a bracket 661 and has on its top end a steering member 67.

As the pedals 52 are riden on, the driving wheel 58 will be rotated via the cranks 59. Then, the driving wheel 74 will rotate the driven gear 53. Since the driven gear 53 and the bevel gear 61 are keyed to the same shaft 531, the bevel gear 61 will rotate in union with the driven gear 53. Then, the bevel gear 61 will drive the first side gear 62 and the second side gear 63 simultaneously. As a result, the first side gear 62 will drive the first pinion 622 via the first hollow axle 621 while the second side gear 63 will drive the second pinion 632 via the second hollow axle 631. Consequently, the bevel gear 71 will be driven by the first pinion 622 and the second pinion 632 thereby rotating the propeller 7 and therefore, moving the pedal boat.

To change the direction of pedal boat, simply turn the steering member 67. As the steering member 67 is turned, the shaft 66 is rotated. Then, the steering axle 64 will be rotated to turn the housing 90. Consequently, the propeller 7 together with the housing 90 will be rotated about the steering axle 64 thereby changing the direction of the pedal boat.

Figure 4:
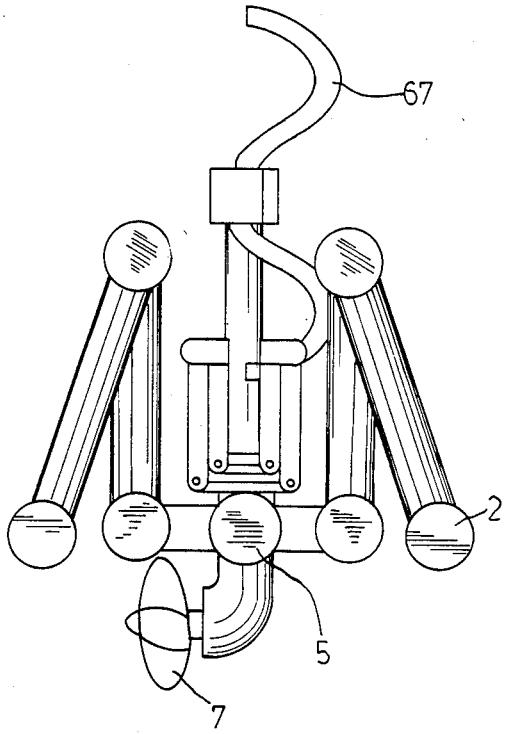
FIG. 4 shows the collapsible condition of the pedal boat.

As the propeller 7 is rotated about the axle 64 and in the same direction as the second pinion 632, the second pinion 632 will be sped up while the first pinion 622 will be slowed down. Since the second pinion 632 is driven by the second hollow axle 631 via the single-way bearing 633, the second pinion 633 will no longer be driven by the second hollow axle 631 when the second pinion 632 is faster than the second hollow axle 631. Meanwhile, the first pinion is still driven by the first hollow axle 621. By means of the first single-way bearing 623, the force applied by the bevel gear 71 against the first pinion 622 fails to be transmitted to the first hollow axle 621. Accordingly, interference between the bevel gear 71 and first pinion 622 is thereby avoided. The propeller 7 may be rotated smoothly about the shaft 64. Consequently, no interference will happen between the bevel gear 71 and the pinions. Furthermore, the pedal boat according to the present invention can be folded into one as shown in FIG. 4 thereby facilitating transportation.

Although this invention has been described with a certain degree of particularity, it is understood that the present disclosure has been made by way of example only and that numerous changes in the detail of construction and the combination and arrangement of parts may be resorted to without departing from the spirit and scope of the invention as hereinafter claimed.

I claim:

1. A pedal boat comprising:

two inflatable members each having a supporting frame therein, said inflatable members being connected by a transverse rod;

a seat mounted on the middle of said transverse rod;

a transmission mechanism including a tubular casing connected at the lower end with a housing, a cylindrical member enclosing the lower part of said tubular casing, a stud mounted on said tubular casing, a bevel gear keyed to said stud, a driven gear mounted on an outer side of said bevel gear and keyed to said stud, a first side gear mounted in said tubular casing and engaged with an upper part of said bevel gear, a second side gear mounted in said tubular casing and engaged with a lower part of said bevel gear, a steering axle extending through said tubular casing, a first hollow axle enclosing said steering axle and fastened to said first side gear, said first hollow axle extending downwardly and connected with a first pinion via a first single-way bearing, a second hollow axle enclosing said first hollow axle and fastened to said second side gear, said second hollow axle extending downwardly and connected with a second pinion via a second single-way bearing;

a contractible rod extending from the middle of said transverse rod, the other end of said contractible rod being secured to said tubular casing of the transmission mechanism;

a steering member being attached to one end of a shaft which is supported by a bracket connected to the contractible rod, the other end of said shaft being connected to a top end of said steering axle with a universal joint;

a pair of pedals, each pivoting on a crank affixed to one end of a shaft which is supported by a supporting member secured to said contractible rod;

drive means connecting said crank to the driven gear; and, a propeller disposed on a shaft secured within said housing, an inside end of the shaft being attached to a bevel gear which is driven by both said first pinion and said second pinion.

* * * * *